US006544468B1

(12) United States Patent
Londardi et al.

(10) Patent No.: US 6,544,468 B1
(45) Date of Patent: Apr. 8, 2003

(54) METHOD FOR COOLING A SHAFT FURNACE LOADING DEVICE

(75) Inventors: Emile Londardi, Bascharage (LU); Jean-Jacques Venturini, Obercom (LU); Giovanni Cimenti, Fentange (LU); Guy Thillen, Diekirch (LU)

(73) Assignee: Paul Wurth S.A., Luxembourg (LU)

( * ) Notice: Subject to any disclaimer, the term of this patent is extended or adjusted under 35 U.S.C. 154(b) by 0 days.

(21) Appl. No.: 09/554,425

(22) PCT Filed: Sep. 28, 1998

(86) PCT No.: PCT/EP98/06153

§ 371 (c)(1),
(2), (4) Date: Sep. 20, 2000

(87) PCT Pub. No.: WO99/28510

PCT Pub. Date: Jun. 10, 1999

(30) Foreign Application Priority Data

Nov. 26, 1997 (LU) ..... 90179

(51) Int. Cl.[7] ..... C21B 7/20
(52) U.S. Cl. ..... 266/46; 266/197; 266/193
(58) Field of Search ..... 266/46, 199, 190, 266/197, 193

(56) References Cited

U.S. PATENT DOCUMENTS

| | | | | |
|---|---|---|---|---|
| 3,880,302 A | | 4/1975 | Legille | 214/35 |
| 4,273,492 A | | 6/1981 | Legille et al. | |
| 4,526,536 A | | 7/1985 | Legille et al. | 432/238 |
| 5,022,806 A | * | 6/1991 | Lonardi et al. | 266/199 |
| 5,252,063 A | * | 10/1993 | Thillen et al. | 432/235 |
| 5,799,777 A | * | 9/1998 | Mailliet et al. | 198/642 |

FOREIGN PATENT DOCUMENTS

| | | | |
|---|---|---|---|
| DE | 3809533A1 | AP | 6/1988 |
| DE | 3809533 | | 10/1988 |
| DE | 4216166 | | 12/1992 |
| DE | 4216166A1 | AP | 12/1992 |
| EP | 0116142 | | 12/1983 |
| EP | 0116142 | AP | 8/1984 |
| GB | 2202616 | | 9/1988 |
| JP | 55021577 | AB | 2/1980 |
| JP | 03013516 | AB | 1/1991 |
| JP | 05033025 | AB | 9/1993 |
| LU | 80112 | | 8/1978 |

OTHER PUBLICATIONS

English Translation of International Preliminary Examination Report (Form PCT/IPEA/409) for PCT/EP98/06153.

* cited by examiner

*Primary Examiner*—Scott Kastler
(74) *Attorney, Agent, or Firm*—Smith, Gambrell & Russell

(57) ABSTRACT

The invention concerns a method for cooling a shaft furnace loading device, said loading device being equipped with a ring-shaped rotary joint (40), provided with a fixed ring-shaped part (56) and a rotating ring-shaped part (46), for supplying cooling liquid to a rotating cooling circuit (36, 38). The invention is characterized in that it consists in feeding the joint (40) fixed part (56) with cooling liquid such that a leakage flow passes in a separating ring-shaped slot (58, 60) between the fixed part (56) and the rotating part (46) of the joint (40), to form therein a liquid joint. Said leakage flow is then collected and drained without passing through the cooling circuit (36, 38).

14 Claims, 6 Drawing Sheets

METHOD FOR COOLING A SHAFT FURNACE LOADING DEVICE

The invention relates to a process for cooling a device for charging a shaft furnace. A device for charging a shaft furnace of the type considered in the invention comprises in particular a support casing mounted on the head of the furnace, loading equipment suspended in a rotatable manner on the support casing, and at least one cooling circuit supported by rotatable charging equipment and fed by a ring-shaped rotating connection device.

Such a charging device is described, for example, in Luxembourg patent application LU 80112. The charging equipment comprises a charging trough suspended in a suspension cage, which is itself suspended in the support casing, in such a way as to be set in rotation, and which is traversed by a central feed channel for the trough. This suspension cage also forms a protection screen around the feed channel, which protects the implementation devices located in the support casing, and in particular against the radiation of heat from the interior of the shaft furnace. The suspension cage for the distribution trough is provided with a cooling circuit. This is supplied by a cooling liquid by means of a ring-shaped rotating connection device, located around the feed channel for the trough. The connection device comprises a rotating shell, which is carried by the suspension cage, and a fixed yoke. This yoke is carried by the support casing, and the rotating shell is arranged with a degree of play in the fixed yoke. Two ring-shaped throats located above are provided in the fixed yoke, in such a way as to juxtapose the outer cylindrical surface of the rotating shell. A number of connection pipes for the cooling circuit define the location of openings in the outer cylindrical surface of the rotating shell opposite the two throats. Sealing devices, which are mounted along the length of the two edges of each throat, are supported on the outer cylindrical surface of the rotating shell, with the aim of ensuring the sealing effect between the rotating shell and the fixed yoke. It has been found that this type of rotating connection, which in particular requires a relatively low amount of play between the rotating shell and the fixed yoke so as to guarantee the seal, is hardly well-suited for a charging device for a shaft furnace. In a shaft furnace, the rotating shell and the fixed yoke in fact risk suffering from very different thermal expansion, as well as mechanical stresses, which rapidly lead to the blockage of the connection with low functional play. in addition to this, in the environment of a shaft furnace, it must always be assumed that there will be substantial volumes of dust present. This dust will inevitably penetrate between the rotating shell and the fixed yoke, where it risks incurring a blockage of the rotating connection or of destroying the sealing devices. It must also be borne in mind that the sealing devices are in contact with a shell which is quite hot, which is hardly favourable to them. It is therefore not surprising that a rotating connection system of this type has never in practice been applied to a shaft furnace.

Accordingly, in 1982, the company of Paul Wurth S. A. proposed a cooling arrangement for a charging installation of a blast furnace without sealing devices. This cooling arrangement, which is described in detail in patent application EP 0 116 142, has been installed in numerous blast furnace charging installations throughout the world. It is characterised by a ring-shaped trough, which is supported by a shell above the rotating cage, which is gravity-fed with cooling water. For this purpose, a cooling water feed duct is integrated in the support casing and features, above the ring-shaped trough, at least one opening allowing for the gravity circulation of the cooling water in the ring-shaped trough in rotation with the suspension cage. The latter is connected to several cooling coils which equip the rotating cage. These coils are outlet ducts, which empty into a ring-shaped collector supported by the lower edge of the support casing. The water consequently flows by gravity, starting from a fixed-position feed pipe in rotation, into the ring-shaped trough in rotation, passing by gravity through the cooling coils mounted on the rotating cage, and then is collected in the lower fixed-position collector, and evacuated on the outside of the support casing. This water circulation system is monitored by level sensors connected to the ring-shaped trough and the lower collector. In the ring-shaped trough, the level is adjusted in such a way as to be constantly between a minimum level and a maximum level. If the level drops as far as the minimum level, the feed outlet of the ring-shaped trough is increased, so as to guarantee the appropriate feed to the coils. If the level rises as far as the maximum level, the feed outlet of the ring-shaped trough will be reduced, so as to avoid overflow from the ring-shaped trough.

A disadvantage of the 1982 cooling arrangement is that the gases from the blast furnace come in contact with the cooling water in the ring-shaped trough. Because these blast furnace gases are heavily laden with dust, substantial quantities of dust pass into the cooling water. This dust forms sludges in the ring-shaped trough, which pass into the cooling coils and risk blocking them. In this context it is appropriate to note, inter alia, that the pressure available to cause the water to pass through the coils is determined essentially by the height differential between the ring-shaped trough and the lower collector.

The present invention, such as defined in Claim One, achieves a significant reduction of the risk of penetration of the dust into the cooling circuit.

The process according to the invention relates more specifically to a device for charging a shaft furnace, comprising: a support casing mounted on the head of the furnace, charging equipment suspended in rotatable fashion in the support casing, a cooling circuit supported by the rotating charging equipment in such a way as to induce rotation in the latter, as well as a ring-shaped rotating connection device, this connection device comprising a fixed part and a rotating part, capable of turning with the rotating charging equipment, the rotating part being separated from the fixed part by means of a ring-shaped separation gap so as to allow for relative rotation. In a known manner, the fixed part of the connection device is fed with a cooling liquid, which passes into the rotating part of the connection device where it feeds the cooling circuit, so as then to be evacuated at the outlet of the cooling circuit on the outside of the support casing. By contrast with arrangements of the state of the art, however, there is no attempt to ensure the perfect sealing of the turning connection, such as provided for, for example, under patent application LU 80112, nor to avoid leaks from the turning connection by means of a system of level sensors, such as is provided for, for example, in patent application EP 0116142. In fact, according to the invention, the feed of a cooling liquid of the turning connection is effected in such a way that a leakage outlet passes through the ring-shaped separation gap, so as to form therein a liquid joint, this leakage outlet being collected and evacuated outside the support casing without passing through the cooling circuit. In other words, the cooling liquid is used to plug the ring-shaped separation gap, which must exist between the rotating and fixed parts of the rotating connection so as to allow for rotation to take place, and which allows for the interior of the cooling circuit to be in communication with the furnace surroundings. The leak rate, which has formed this liquid joint, is then collected and evacuated directly outside the support casing, without passing through the cooling circuit. The result of this is that the dust sludges formed in the gap no longer pass through the cooling circuit and therefore do not incur the risk of blockage.

In most cases, it will be of advantage to provide the connection device with elements which are capable of creating an additional charge loss at the level of the ring-shaped separation gap, in such a way that the feed pressure of the cooling liquid may be perceptibly higher than the counter-pressure which prevails in the support casing, without generating any too substantial leak rate. In other words, the invention allows for the first time for a cooling circuit for rotating charging equipment to be fed with suppression capability. This not being further limited from the point of view of feed pressure, it is plainly possible to create cooling circuits of higher performance. It will also be appreciated that the leak rate which passes through those elements which are prone to incur a loss in supplementary pressure (such as fittings, elastomer joints, labyrinth joints, etc.) guarantees a cooling effect, a certain degree of lubrication, and the constant cleaning of these elements, which undoubtedly has a beneficial effect on their service life.

In a first embodiment, the connection device consists of a ring-shaped block carried by the support casing, and delimited by two cylindrical surfaces, as well as a ring-shaped channel, carried by the loading equipment and delimited by two cylindrical surfaces. The ring-shaped block, fixed in rotation, penetrates into the ring-shaped channel in such a way that the juxtaposed cylindrical surfaces delimit two ring-shaped spaces which form part of said ring-shaped separation gap. The ring-shaped channel is provided to advantage with overflow apertures connected to the pipes for evacuating the leak rate. So as to create an additional loss of charge, which reduces the leak rate when the cooling water feed pressure is increased, provision is made between the two juxtaposed cylindrical surfaces, below the overflow apertures, for elastomer ring-shaped joints, such as lip joints. The ring-shaped block, which is carried by the support casing, comprises to advantage a number of passages which allow for communication between the two ring-shaped spaces, in such a way that there is pressure equilibrium between the two ring-shaped spaces.

According to a second embodiment, the connection device comprises a ring, provided with a ring-shaped front surface fixed in rotation, as well as a ring-shaped channel of one piece wit the charging equipment. The ring is located in the ring-shaped channel in such a way that its front ring-shaped surface is positioned opposite a ring-shaped surface in the ring-shaped channel, a ring-shaped gap separating the two juxtaposed ring-shaped surfaces. A set of fittings is then arranged between the two ring-shaped surfaces, so as to create an additional loss of charge in said separation ring. The ring is to advantage mounted in such a way that it can undergo translation parallel to the axis of rotation, in order for it to be able to exercise a certain amount of pressure on the set of fittings. In a first embodiment, the ring is supported by compensators, in such a way as to be able to undergo slight displacement parallel to the axis of rotation. In a second embodiment, the ring is connected with the aid of a sliding connection to a fixed ring-shaped block, in such a way as to be able to slide parallel to the axis of rotation.

According to another embodiment, the ring-shaped separation gap forms at least one labyrinth joint. In this case, the connection device comprises to advantage a ring-shaped block which is carried by the support casing and delimit laterally by two staged ring-shaped surfaces, as well as a ring-shaped channel, carried by the charging equipment and delimited laterally by two staged ring-shaped surfaces, in a complementary manner. The ring-shaped block then penetrates into the ring-shaped channel in such a way that the two juxtaposed staged surfaces interact so as to form a labyrinth joint, which forms part of said ring-shaped separation gap. As already described previously, the ring-shaped channel is provided to advantage with overflow apertures connected to the pipes for evacuating the leak rate, and located above the labyrinth joint, and the ring-shaped block, carried by the support casing, comprises to advantage passages which allow for communication between the two ring-shaped spaces.

BRIEF DESCRIPTION OF THE DRAWINGS

Other characteristics and advantages can be identified from the detailed description of the advantageous embodiment presented by way of illustration hereinafter, making reference to the appended drawings. These show:

FIG. 1 shows a schematic representation of a charging installation for a shaft furnace, provided with a distribution trough 10. The latter is set in rotation about the central axis of the shaft furnace, indicated by reference number 8. An installation of this type is described in detail, for example, in patent U.S. Pat. No. 3,880,302. It is important to note, however, that the present invention relates in a general manner to any charging installation for a shaft furnace, comprising charging equipment which is suspended in such a way as to be able to be set n motion about an axis. It is certainly not limited to an installation of the type described in the patent U.S. Pat. No. 3,880,302.

Figure 1:
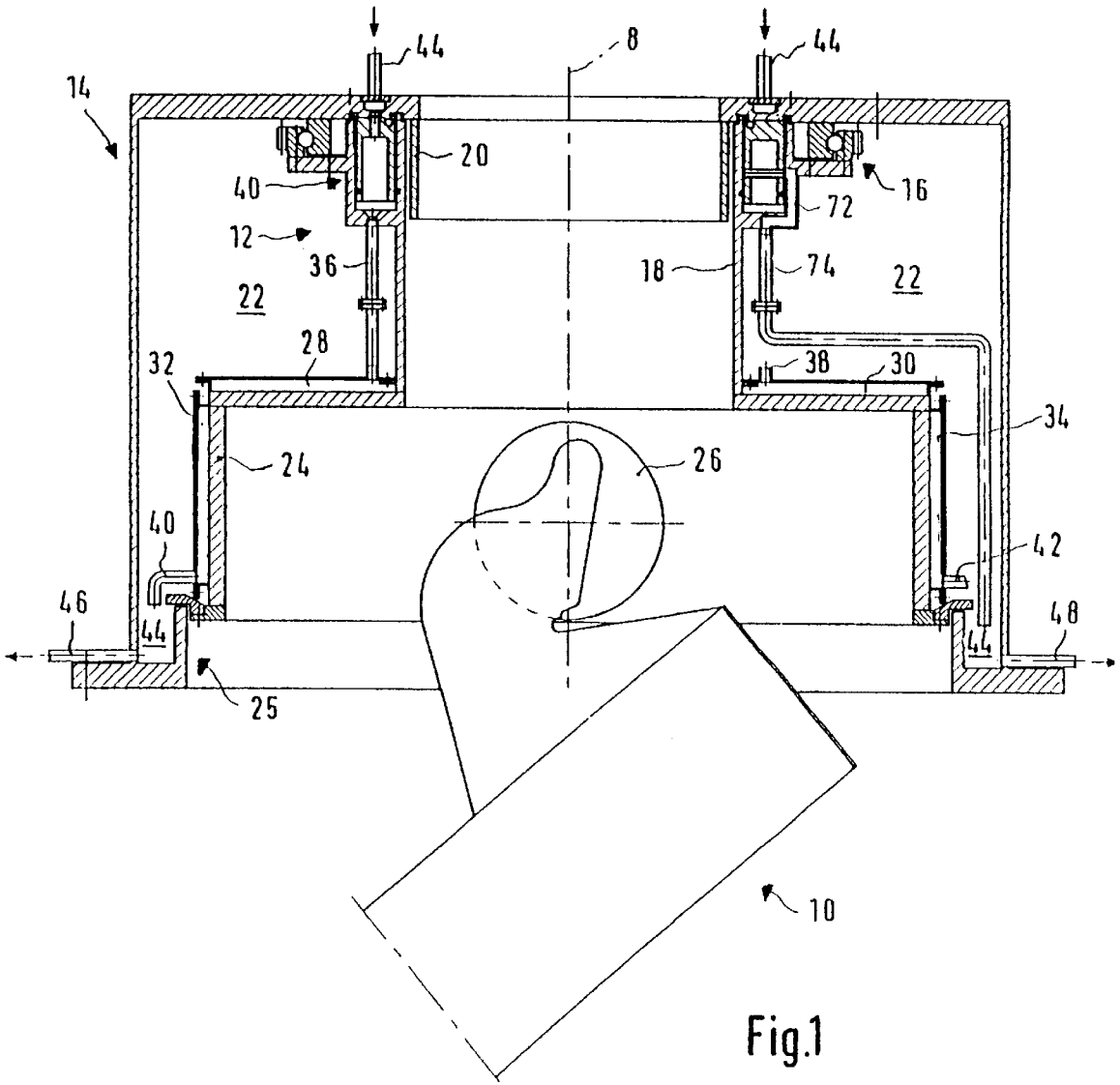
FIG. 1 is a vertical section through a charging device for a shaft furnace, suitable for cooling by the process according to the invention.

The trough 10 is suspended with the aid of a suspension and movement initiation device, referred to overall by the number 12, in a support casing 14 mounted on the shaft furnace. This device 12 comprises a toothed crown element 16 which serves to set in rotation a hell element 18 about a central feed channel 20, fixed in rotation. The movement is initiated with the aid of a motor, not shown. As described in the patent U.S. Pat. No. 3,880,302, the suspension and movement initiation device 12 may, in addition, comprise a mechanism allowing for angular adjustment of the trough 10 by pivoting about a horizontal axis.

The support casing 14 is delimited laterally, with the rotatable shell element 18, by a ring-shaped chamber 22, in which is located, for example, the mechanism for pivoting the trough 10. The rotating shell 18 is carried by a cage 24, in which the trough 10 is suspended with the aid of trunnions 26. This cage 24 also functions as a screen between the lower edge of the rotating shell 18 and the lower edge 25 of the support casing 14, in such a way as to separate the ring-shaped chamber 22 from the interior of the furnace.

It is evident that the parts most exposed to the radiant heat of the furnace are the walls of the cage 24. So as to protect these walls from high temperatures, and to avoid them passing the heat on, either by conduction or by radiation, to other elements of the suspension and movement initiation device 12, this cage 24 is provided with several cooling circuits, in which a cooling liquid is circulated, such as water. In FIG. 1 these circuits are represented in schematic form by cooling box structures 28, 30, 32, 34. The latter contain to advantage baffles or pipes (not shown) which allow the cooling water to circulate along the walls of the cage 24. The box structures 28, 30, 32, 34 are connected by means of pipework 36, 38, with a rotating ring-shaped connection device, indicated overall by the reference number 40. The latter will be described in detail hereinafter with the aid of FIGS. 2 and 3. In FIG. 1 the evacuation of the water of the cooling circuits 28, 30, 32, 34, can again be seen, which is effected by means of pipes 40, 42, into a ring-shaped collector 44 fixed to the lower edge 25 of the support casing 14. From the ring-shaped collector 44, the cooling water is initially evacuated by evacuation pipework 46, 48, to the outside of the support casing 14. In addition to the cooling circuits 28, 30, 32, 34, shown in FIG. 1, the trough 10 itself can be provided with a cooling circuit which is fed for preference at the suspension cage 24 via the suspension trunnions 26. This additional circuit can be equipped with its own connection to the ring-shaped rotating device 40, or connected to one of the cooling circuits 28, 30, 32, 34.

Figure 2:
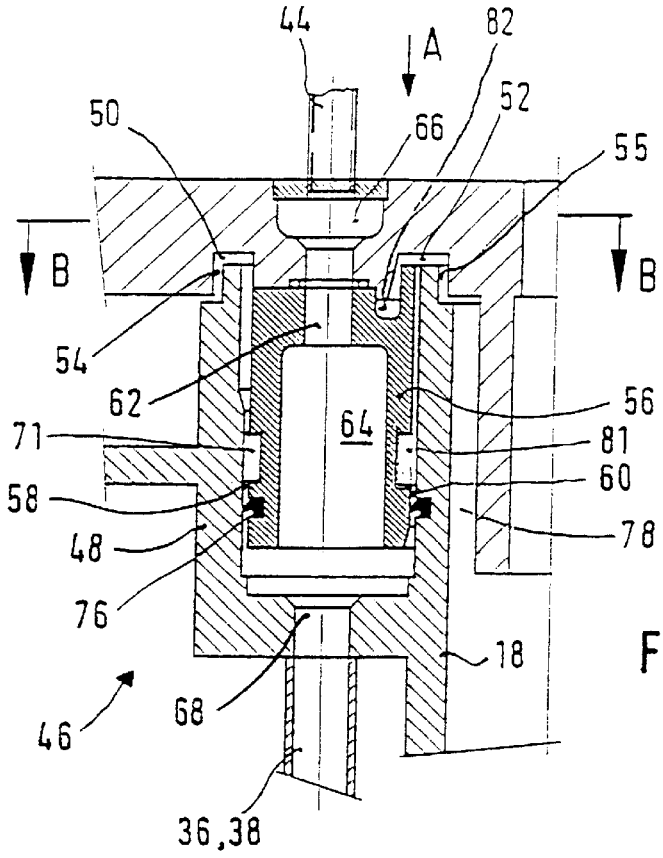
FIG. 2 is a vertical section through a ring-shaped rotating connection device fitted to the charging equipment of a shaft furnace from FIG. 1.
Figure 3:
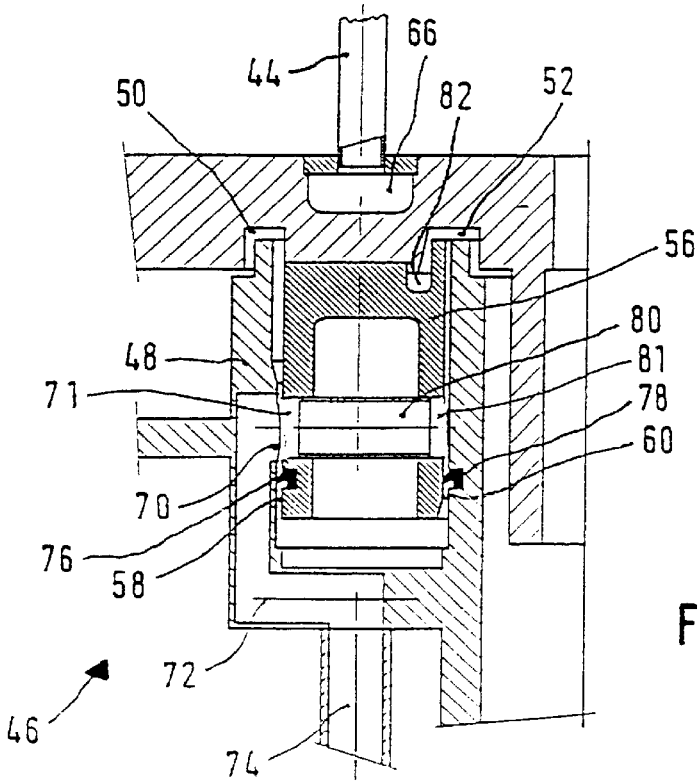
FIG. 3 is another vertical section through the ring-shaped rotating connection device fitted to the charging equipment of a shaft furnace of FIG. 1.
Figure 9:
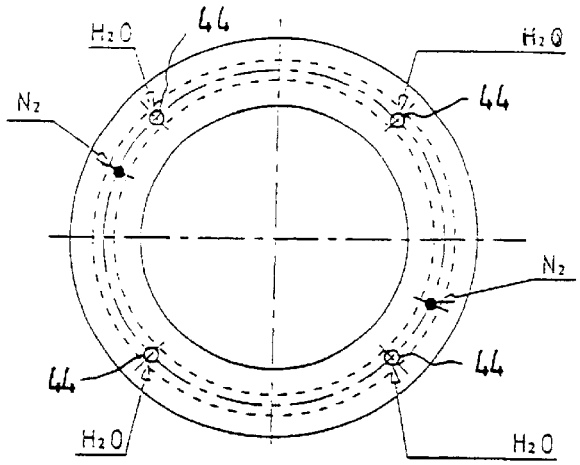
FIG. 9 is a plan view of the rotating connection devices according to arrow A in FIGS. 2, 4, 6 and 8.
Figure 10:
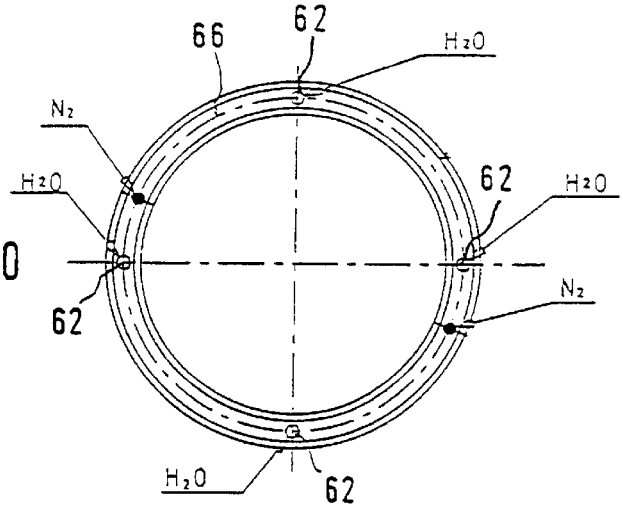
FIG. 10 is a simplified horizontal section according to the arrows B—B of FIGS. 2, 4, 6 and 8.

A more detailed description will now be given, with the aid of FIGS. 2 and 3, of a first embodiment of the ring-shaped rotating connection device 40. This comprises essentially a fixed part, connected to a stationary feed circuit (represented by a pipe 44) and a rotating part connected to the cooling circuits 28, 30, 32, 34 via the pipe 36. The rotating part is essentially a ring-shaped trough 46, which defines a ring-shaped channel 47, which is delimited laterally by two coaxial cylindrical surfaces. One of the two cylindrical surfaces is defined by the outer wall of the shell element 18, and the other is defined by a crown element 48, surrounding the shell element 18. The upper edges of the shell 18 and the crown element 48 slide, during the rotation of the trough 10, each in a ring-shaped groove 50, 52, arranged in a fixed element of the outer body 14, in such a way as to create a first pair of ring-shaped gaps 54, 55, between the fixed part and the rotating part. This first pair of ring-shaped gaps 54, 55, is aimed at retarding the penetration of dust-laden gas into the ring-shaped trough 46. The fixed part of the connection device 40 consists essentially of a ring-shaped block 56 fixed to the support casing 14, and delimited on the outside by two cylindrical surfaces. This ring-shaped block 56 is located in the ring-shaped channel 47 in such a way that its outer cylindrical surfaces delimit, together with the juxtaposed cylindrical surfaces of the channel 47, a second pair of ring-shaped gaps 58, 60, between the fixed part and the rotating part of the connection device 40. The ring-shaped block 56 comprises at least one passage aperture 62, which provides communication between a ring-shaped chamber 64 and a ring-shaped feed channel 66, into which the fixed feed pipes 44 empty. As a comparison of FIGS. 9 and 10 shows, the mouths of four feed ducts 44 in the ring-shaped feed channel 66, are considerably off-centre in relation to the passage apertures 62. The connection pipes 36, 38, of the cooling circuits 28, 30, 32, 34, feature a mouth outlet 68 in the base of the channel 47.

So as to cool the rotating cage 24, the ducts 44 are fed with cooling water. This water passes into the ring-shaped channel 66, which it must pass through before leaving via the passages 62. It will be noted that the water which passes through the ring-shaped channel 66 fulfils the role of a thermal barrier between the central supply channel 20 and the upper plate of the support casing 14, and also ensures the cooling of the suspension device 12. The water then flows across the ring-shaped chamber 64 of the fixed block 56 in the ring-shaped channel 47 of the trough 46. It passes through the apertures 68 in the base of the channel 47 into the connecting pipes 36, 38, of the cooling circuits 28, 30, 32, 34. At the outlet of these circuits the cooling water flows via the pipes 40, 42, into the ring-shaped collector 44, which is again fixed in rotation, so as to be evacuated via the evacuation pipes 46, 48, to the outside of the body structure 14.

According to an important feature of the invention, the feed of a cooling liquid for the rotating connection 40 is effected in such a way that any leak rate passes through the two ring-shaped gaps 58, 60, to form therein a liquid joint. This leak rate is then collected and evacuated outside the support casing 14 without passing through one of the cooling circuits 28, 30, 32, 34. The means used to collect the leak rate in the two ring-shaped gaps 58, 60, are described with the aid of FIG. 3. Located in the crown element 48 is at least one overflow aperture 70. A ring-shaped outlet 71 in the ring-shaped block 56 facilitates the flow of the leak rate through the overflow apertures 70. The overflow aperture 70 communicates via a channel 72 with an evacuation pipe 74. In FIG. 1, the evacuation pipe 74, which opens into the ring-shaped collector 44 is shown in the right-hand part of the Figure. In FIGS. 2 and 3, it can again be seen that each of the two ring-shaped gaps 58, 60, is provided with a joint 76, 78, located below the level of the overflow aperture 70. These joints 76, 78, are for preference lipped elastomer joints, the aim of which is to create an additional charge loss at the level of the two ring-shaped gaps 58, 60, in such a way that the feed pressure of the cooling liquid can be perceptibly higher than the counter-pressure pertaining in the furnace, without generating an excessive leak rate. It is important, as a consequence, to note that, when functioning normally, these elastomer joints 76, 78, are not intended to avoid leaks, but to limit the leak rate to an acceptable level. In FIG. 3, it can again be seen that the ring-shaped gap 58 communicates with the ring-shaped gap 60 by means of at least one passage 80 through the ring-shaped block 56. These passages 80 allow for the leak water outlet to be evacuated, which passes through the ring-shaped gap 60. A ring-shaped outlet 81 in the ring-shaped block 56 facilitates the flow of this outlet through the passages 80.

It will be appreciated that the elastomer joints 76, 78, are constantly cooled, "lubricated", and cleaned by the leak rate which passes below them. This leak rate carries away all the solid matter which might be introduced through the two ring-shaped gaps 58, 60. In order also to protect the two ring-shaped gaps 58, 60, against the accumulation of dust, it is recommended that a clean gas be injected into the furnace via the joints 54, 55. In FIGS. 2 and 3 a ring-shaped channel 82 can be seen, which allows for a gas to be injected, such as nitrogen, for example, through the joint 55 and into the shell 18.

Figure 4:
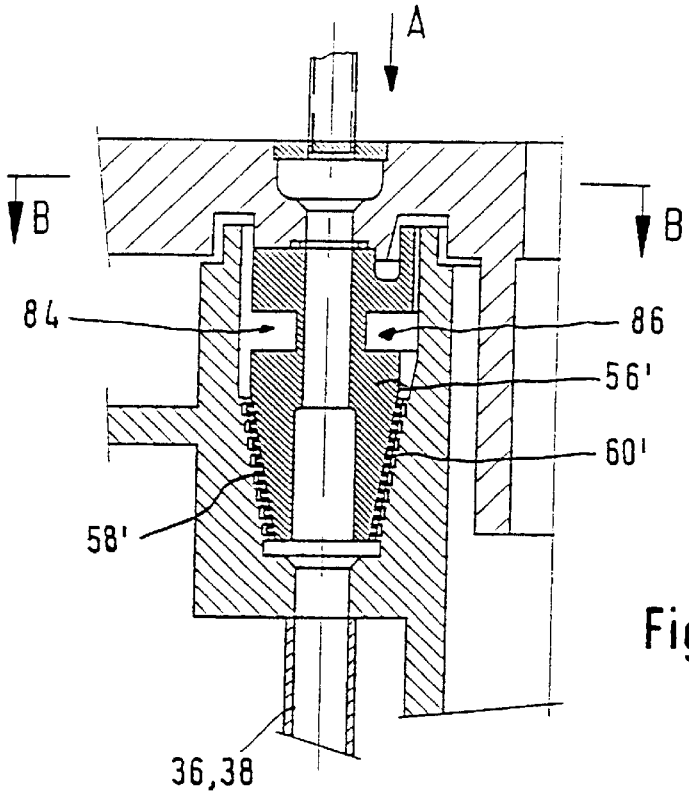
FIG. 4 is a vertical section through a variant design of the rotating connection device.
Figure 5:
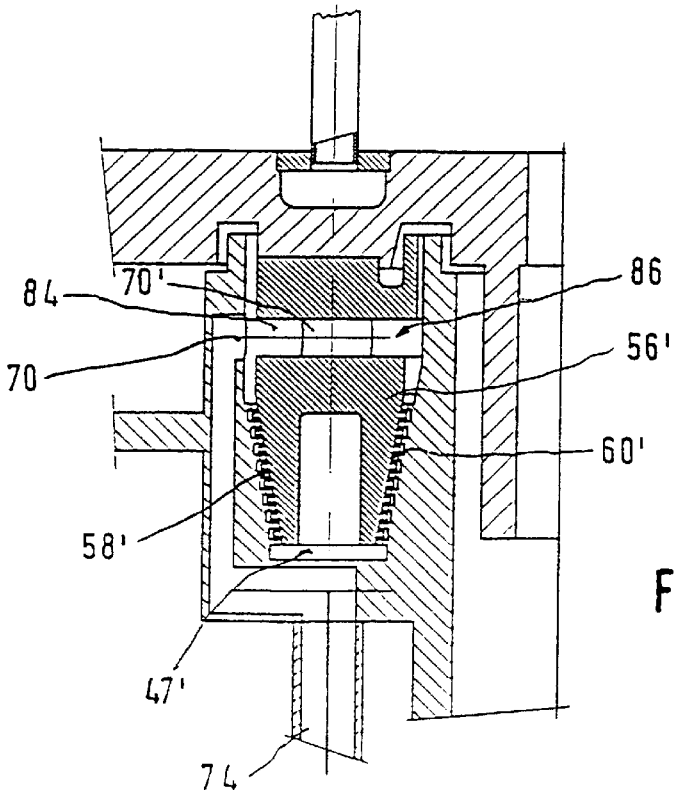
FIG. 5 is another vertical section through the variant design of the rotating connection device according to FIG. 4.

A variant design of the rotating ring-shaped connection device is described with the aid of FIGS. 4 and 5. This device is distinguished from the device in FIGS. 2 and 3 essentially by the fact that the second pair of ring-shaped gaps 58, 60, are designed in the form of labyrinth joints 58', 60'. So as to be able to introduce the ring-shaped block 56' into the ring-shaped channel 47', so as to form the two labyrinth joints 58', 60', staged trapezoidal sections have been applied to the block 56' and the channel 47', which interact so as to form the two labyrinth joints 58', 60'. It remains to be noted that, at the level of the overflow aperture, provision has been made in the block 56' for ring-shaped throat elements 84, 86, so as to facilitate the flow of a substantial leak rate. These ring-shaped throat elements are connected by at least one passage 70', which fulfils the same function as the passage 70 of the device in FIGS. 2 and 3. It will be noted that the leak rate which occurs via the two labyrinth joints 58', 60', cools the elements which form the labyrinth joints, avoids the penetration of gas into the cooling circuit, carries away the solid matter which might other infiltrate into the labyrinth joints, and purges the dust sludge which might form in the channel 47' above the two joints 58', 60'.

Figure 6:
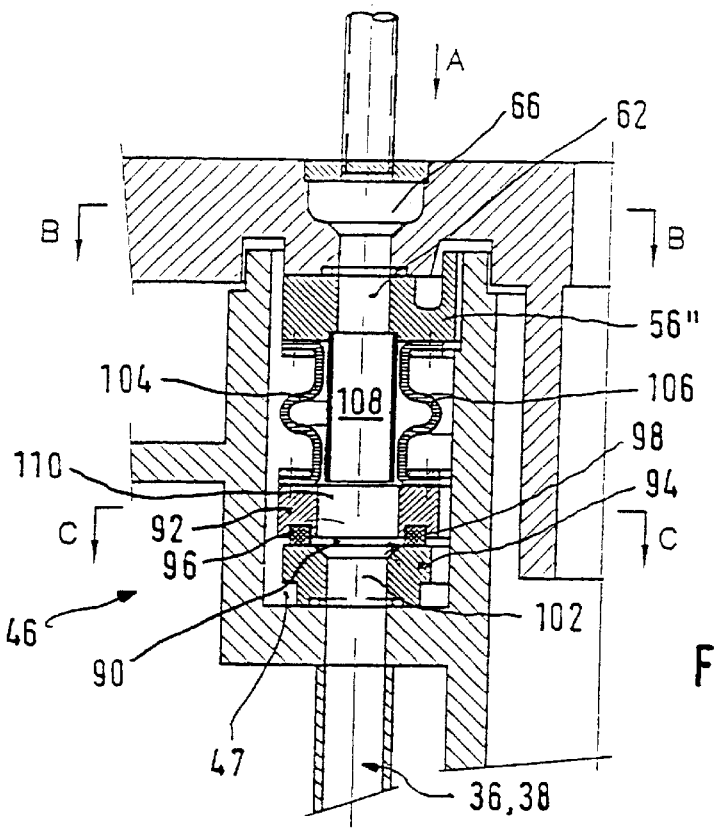
FIG. 6 is a vertical section through a second embodiment of the rotating connection device.
Figure 7:
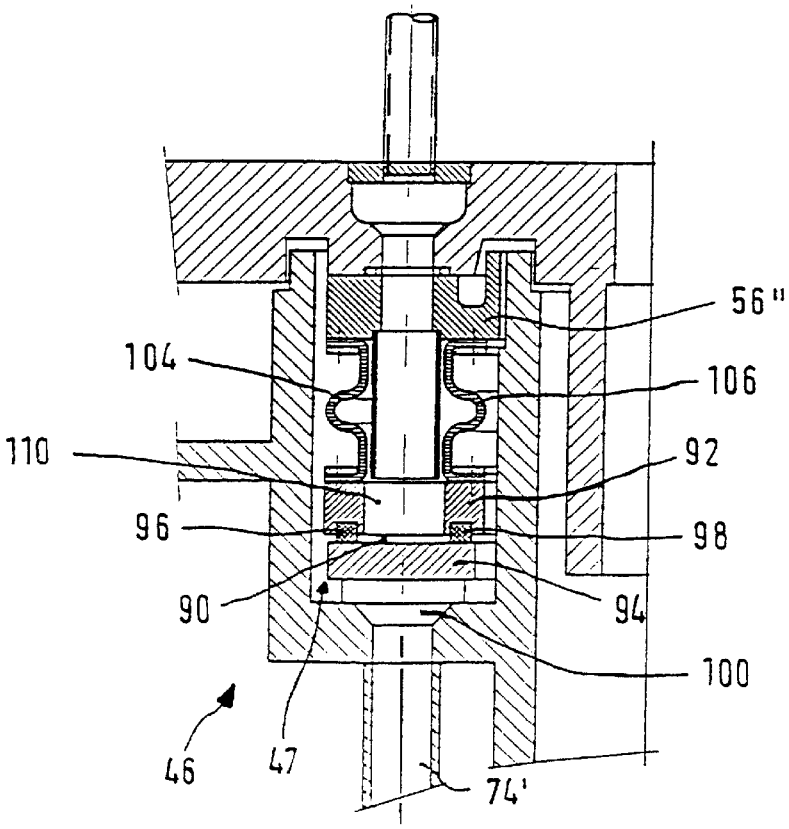
FIG. 7 is another vertical section through the variant design of the rotating connection device according to FIG. 6.
Figure 11:
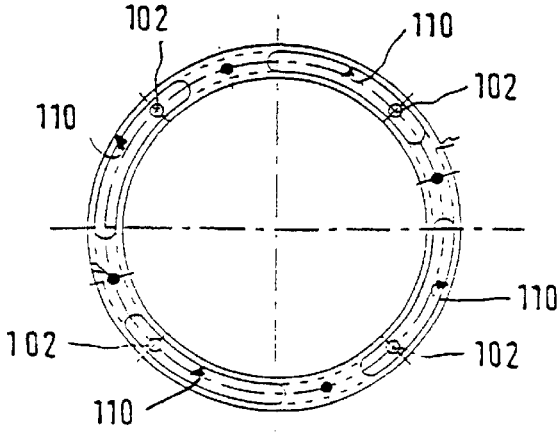
FIG. 11 is a simplified horizontal section according to the arrows C—C of FIGS. 6 and 8.

Another embodiment of a ring-shaped rotating connection device is described with the aid of FIGS. 6 and 7. This device is distinguished from the device in FIGS. 2 and 3 essentially by the fact that the second pair of ring-shaped gaps 58, 60, are replaced by a single frontal ring-shaped gap 90, which separates one ring-shaped frontal face of a ring element 92, fixed in rotation, from a frontal ring-shaped surface of a ring element 94, mounted in the trough 46. Mounted between the two rings 92 and 94 are two fittings 96, 98, in such a way that they delimit a ring-shaped space between them. The purpose of these fittings 96, 98, is to create an additional loss of charge at the level of the frontal gap 90, in such a way that the feed pressure of the cooling liquid may be perceptibly higher than the counter-pressure prevailing in the channel 47, but without generating an excessive leak rate. It is important as a consequence to note that, when these devices 96, 98, are functioning normally, their purpose is not to avoid leaks, but to limit the leak rate to an acceptable level. The leak rate which passes below these devices 96, 98, flows into the ring-shaped channel 47. In FIG. 7, it can be seen that the latter is provided, at the level of its base, in a cavity below the ring 94, with at least one aperture 100 in an evacuation pipe 74', which opens, like its equivalent, the evacuation pipe 74 in FIG. 1, into the ring-shaped collector 44. The main outlet of the cooling water passes through the mouths 102 into the ring element 94 into the connecting pipes 36, 38, of the cooling circuit. The ring element 92 is connected to a ring-shaped block 56" (which corresponds to the upper part of the ring-shaped block 56 in FIGS. 2 and 3), with the aid of two co-axial compensators 104, 106. These latter elements allow the ring element 92 to be placed on the ring element 94, and to ensure a certain degree of compression of the fittings 96, 98. So as to ensure adequate compression on the fittings 96, 98, it is in principle the weight of the ring element 92 which is applied. Moving across a ring-shaped space 108, delimited by the two co-axial compensators 104, 106, the cooling water passes into the communications apertures 110 arranged in the ring element 92. FIG. 11 shows in sectional form the communication apertures 110, oblong in shape, as well as the mouths 102 of the connecting pipes 36, 38, of the cooling circuits 28, 30, 32, 34. The four black dots in FIG. 11 indicate the locations of four mouths 102 of evacuation pipes 74' for the leak rate. It remains to be noted that the two large compensators 104 and 106 may possibly be replaced by small-diameter compensators, directly extending the passages 62 into a ring-shaped chamber arranged in the ring element 92.

Figure 8:
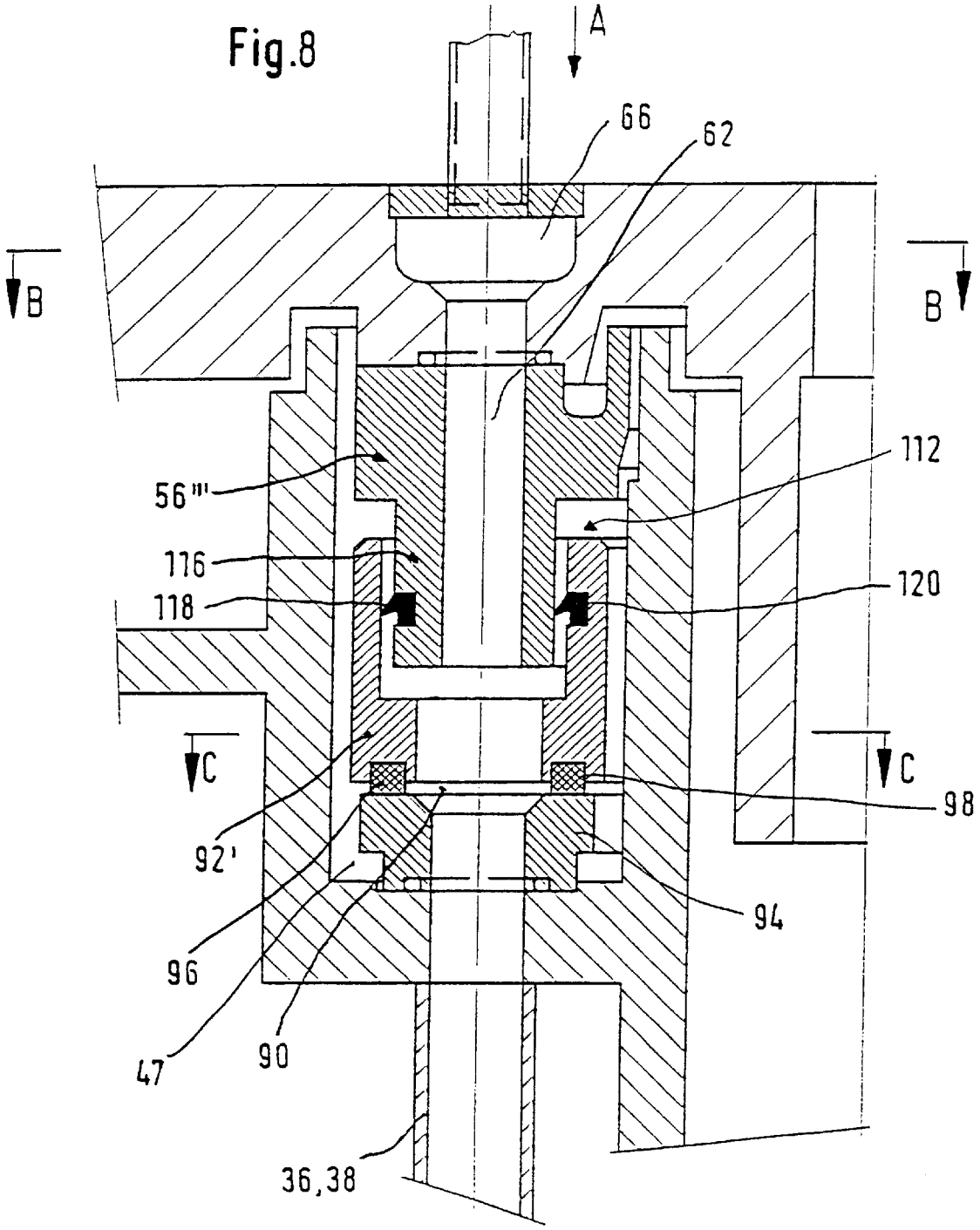
FIG. 8 is a vertical section through a third embodiment of the rotating connection device.

An additional embodiment of a ring-shaped rotating connection device is described with the aid of FIG. 8. This device is distinguished from the device in FIGS. 6 and 7 essentially due to the fact that the compensators 104, 106 are replaced by a sliding ring-shaped connector 112, arranged between a ring element 92', which is the equivalent of the ring element 92, and a ring-shaped block 56", which is the equivalent of the ring-shaped block 56". So as to provide this sliding ring-shaped connection 112, the ring element 92' is provided with a ring-shaped chamber 114, in which is located the ring-shaped end 116 of the block 56". Elastomer joints 118, 120 improve the sealing capacity of the sliding joint 112. It will be appreciated that these elastomer joints 118, 120, are subjected to much less stress than the elastomer joints 76, 78, of the device in FIGS. 2 and 3, since the ring element 92' is blocked in rotation. So as to ensure adequate compression of the fittings 96, 98, recourse is made in principle to the weight of the ring 92'. The possibility is not excluded, however, of governing this compression force with the aid of spring (not shown), which are fitted between the ring element 92' and the ring-shaped block 56". It remains to be noted that the pressure of the water in the chamber 114 also contributes towards providing a slight increase in the compression of the fittings 96, 98. It will, however, always be necessary to guarantee a residual leak rate, sufficient to cool, "lubricate", and clean the fittings and to purge all the dust which might be introduced into the channel 47.

What is claimed is:

1. A process for cooling a charging device of a shaft furnace, said charging device including a support casing mounted on said shaft furnace, charging equipment suspended in a rotatable manner in said support casing, at least one cooling circuit carried by said charging equipment and a ring-shaped rotating connection device, said connection device including a fixed ring-shaped part immobile in rotation, and a rotating ring-shaped part in rotation with said charging equipment, said rotating ring-shaped part being separated from said fixed ring-shaped part by a ring-shaped separation gap;

said process comprising:

a) feeding said fixed ring-shaped part of said connection device with a cooling liquid flow;

b) passing a first sub-flow of said cooling liquid flow as a leakage flow through said ring-shaped separation gap so as to form therein a liquid joint, collecting said leakage flow and evacuating said leakage flow out of said support casing without passing said leakage flow through said at least one cooling circuit; and c) transferring a second sub-flow of said cooling liquid flow from said fixed ring-shaped part onto said rotating ring-shaped part of said connection device, passing said second sub-flow as a cooling flow through said at least one cooling circuit before evacuating said second sub-flow out of said support casing.

2. The process according to claim 1, wherein said support casing is maintained under a counter-pressure; and step a) comprises feeding said fixed ring-shaped part of said connection device with a cooling liquid flow at a feed pressure that is higher than said counter-pressure; and wherein step b) comprises limiting said leakage flow by creating a loss of charge at a level of said ring-shaped gap.

3. The process according to claim 1, wherein said connection device includes a ring-shaped block, which is carried by said support casing and delimited by two cylindrical surfaces, and a ring-shaped channel, which is carried by said charging equipment and delimited by two cylindrical surfaces, said ring-shaped block penetrating into said ring-shaped channel so that said cylindrical surfaces of said ring-shaped block and said ring-shaped channel are juxtaposed and co-operate to delimit two ring-shaped spaces in said ring-shaped channel; and wherein step b) comprises passing said leakage flow through said two ring-shaped spaces so as to form a liquid joint between said juxtaposed cylindrical surfaces of said ring-shaped block and said ring-shaped channel.

4. The process according to claim 3, wherein step b) further comprises evacuating said leakage flow through overflow apertures provided in said ring-shaped channel; and collecting said leakage flow by means of evacuation pipes connected to said overflow apertures.

5. The process according to claim 3, wherein step b) further comprises establishing a pressure equilibrium between said two ring-shaped spaces by means of passages in said ring-shaped block.

6. The process according to claim 4, wherein in step b) said leakage flow is limited by means of ring-shaped lip joints arranged between said juxtaposed cylindrical surfaces below said overflow apertures.

7. The process according to claim 1, wherein said connection device includes a ring element, which is fixed in rotation and provided with a ring-shaped frontal surface, and a ring-shaped channel, which is carried by said rotating-charging equipment and provided with a ring-shaped bottom surface, said ring element penetrating in said ring-shaped channel so that a ring-shaped frontal surface of said ring-shaped channel and said ring-shaped bottom surface are separated by a ring-shaped separation gap; and wherein step b) comprises passing said leakage flow through said ring-shaped separation gap so as to form a liquid joint between said ring-shaped frontal surface and said ring-shaped bottom surface.

8. The process according to claim 7, wherein in step b) the leakage flow through said ring-shaped separation gap is limited by means of a set of fittings arranged between said ring-shaped frontal surface and said ring-shaped bottom surface.

9. The process according to claim 8, wherein said ring element is mounted in such a way as to be axially displaceable; and wherein step b) comprises placing said set of fittings under axial pressure between said ring-shaped frontal surface and said ring-shaped bottom surface.

10. The process according to claim 8, wherein said ring element is mounted on compensators in such a way as to be axially displaceable; and wherein step b) comprises placing said set of fittings under axial pressure between said ring-shaped frontal surface and said ring-shaped bottom surface.

11. The process according to claim 8, wherein said connection device includes a ring-shaped block supported by said support casing, and said ring element is connected to said ring-shaped block by means of a sliding connection in such a way as to be axially displaceable; and wherein step b) comprises placing said set of fittings under axial pressure between said ring-shaped frontal surface and said ring-shaped bottom surface.

12. The process according to claim 1, wherein step b) said leakage flow is limited by means of a labyrinth joint within said ring-shaped separation gap.

13. The process according to claim 1, wherein said connection device includes a ring-shaped block, which is carried by said support casing and laterally delimited by two staged ring-shaped surfaces, and a ring-shaped channel, which is carried by said charging equipment and laterally delimited by two complementarily staged ring-shaped surfaces, said ring-shaped block penetrating into the ring-shaped channel in such a way that said staged surfaces are juxtaposed and co-operate to form labyrinth joints; and wherein step b) further comprises passing said leakage flow through said labyrinth joints.

14. The process according to claim 13, wherein step b) further comprises evacuating said leakage flow through overflow apertures provided in said ring-shaped channel; and collecting said leakage flow by means of evacuation pipes, which are connected to said overflow apertures.

* * * * *